US005399138A

United States Patent [19]

Jones

[11] Patent Number: 5,399,138

[45] Date of Patent: Mar. 21, 1995

[54] PORTABLE EXERCISE DEVICE

[76] Inventor: Deanna L. Jones, 1585 Beach Park Blvd., Foster City, Calif. 94404

[21] Appl. No.: 194,938

[22] Filed: Feb. 14, 1994

Related U.S. Application Data

[63] Continuation-in-part of Ser. No. 18,015, Feb. 16, 1993, abandoned.

[51] Int. Cl.[6] ..... A63B 21/02; A63B 21/045

[52] U.S. Cl. ..... 482/127; 482/122; 482/126

[58] Field of Search ..... 482/121, 122, 126, 127

[56] References Cited

U.S. PATENT DOCUMENTS

D. 322,827 12/1991 Bennstrom et al. .
4,465,276 8/1984 Cox .
4,483,533 11/1984 Manciapane .
4,861,022 8/1989 Boatcollie .
5,026,050 6/1991 Leung et al. .

FOREIGN PATENT DOCUMENTS 1167711 4/1964 Germany .
1428827 11/1968 Germany .

OTHER PUBLICATIONS

Advertising Brochure of NordicTrack for Body Shaper.

Advertisement Brochure for *Thigh Master,* 1991 Body Solutions.

*Primary Examiner*—Richard J. Apley
*Assistant Examiner*—Lynne A. Reichard
*Attorney, Agent, or Firm*—Flehr, Hohbach, Test, Albritton & Herbert

[57] ABSTRACT

A portable exercise device for use by a human which includes a helical spring and first and second spaced apart arms adapted for engagement by the human. The arms have proximal and distal portions, the spring biasing the arms toward a first position and permitting them to pivot thereabout to a second position when so urged by the human. The arm proximal portions are joined to the spring so that when the arms are in the first position the proximal portions extend from the spring in the same general direction and are generally parallel to each other and when the arms are in the second position the proximal portions are angled apart from the spring. The exercise device further includes padding mounted on the distal portions for cushioning the human during use of the device. When the device is used as an abduction exercise device, the arm distal portions curve toward each other and each have a generally looped configuration. The arm distal portions can be removed to permit conversion of the device from an abduction exercise device to an adduction exercise device.

16 Claims, 3 Drawing Sheets

PORTABLE EXERCISE DEVICE

This application is a continuation-in-part of application Ser. No. 08/018,015, filed Feb. 16, 1993, now abandoned.

BACKGROUND OF THE INVENTION

1. Field of the Invention

This invention relates generally to exercise devices for humans and more particularly to portable exercise devices.

2. Description of the Prior Art

Portable exercising devices are available which are formed from rods with central helical portions and two arms extending therefrom (See U.S. Pat. Nos. 4,483,533 and 5,026,050). However, the devices disclosed in U.S. Pat. Nos. 4,483,533 and 5,026,050 are designed specifically as adduction exercise devices for exercising certain muscle groups, such as those of the inner thighs and arms, by bringing limbs together. Some adduction exercise devices can be used to exercise the outer muscles of a leg through outwardly extension of one leg, and in this manner be used as an abduction exercise device. However, these devices cannot exercise those muscles on both legs simultaneously. In addition, these devices can slip loose and be propelled from the user when used in this manner, possibly causing injury or damage.

Abduction exercise machines have been heretofore provided, but most of these machines are stationary and stand alone machines.

Exercise devices have been provided for placement between the muscles of the buttocks for exercising the muscles of the pelvic girdle. Exercises of this type are called Kegal exercises. These devices suffer from the disadvantage, however, of being close to the pivot point of the hip joint. As a result, the forces needed to exercise with these devices and the benefits derived therefrom are not significant.

As can be seen from the foregoing, there is a need for a new and improved exercise device which overcomes these disadvantages.

SUMMARY OF THE INVENTION

In general, it is an object of the present invention to provide a portable abduction exercise device for humans.

Another object of the invention is to provide an exercise device of the above character which is simple in design.

Another object of the invention is to provide an exercise device of the above character which can exercise the outer muscles of the legs or arms.

Another object of the invention is to provide an exercise device of the above character which is configured to grip the legs of the human when being used to exercise the legs.

Another object of the invention is to provide an exercise device of the above character which need not be held by the hands of the human when being used to exercise the muscles of the legs and buttocks.

Another object of the invention is to provide an exercise device of the above character which is relatively compact for ease of storage and transportation.

Another object of the invention is to provide an exercise device of the above character which can be converted to an adduction exercise device.

These and other objects are achieved in accordance with the invention by providing a portable exercise device for use by a human which includes a spring means and first and second spaced apart arms adapted for engagement by the human. The arms have proximal and distal portions, the spring means biasing the arms toward a first position and permitting them to pivot thereabout to a second position when so urged by the human. The arm proximal portions are joined to the spring means so that when the arms are in the first position the proximal portions extend from the spring means in the same general direction and are generally parallel to each other and when the arms are in the second position the proximal portions are angled apart from the spring means. The exercise device further includes padding mounted on the distal portions for cushioning the human during use of the device.

When the exercise device is used as an abduction exercise device, in a preferred form of the device the arm distal portions curve toward each other and each have a generally looped configuration. In one form of the invention, the device can include coupling means for removably attaching the distal portions so as to permit conversion of the device from an abduction exercise device to an adduction exercise device.

DETAILED DESCRIPTION OF THE PREFERRED EMBODIMENTS

Figure 1:
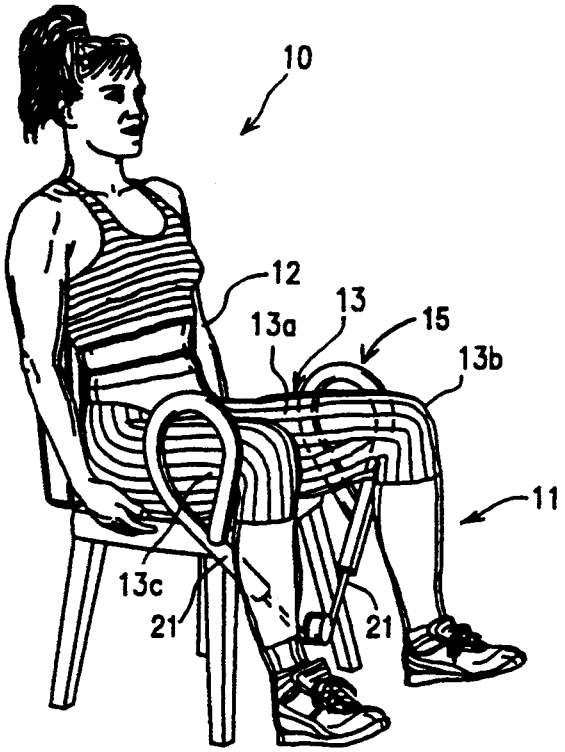
FIG. 1 is a perspective view of the portable exercise device of the present invention shown in use.

Turning now to the drawings, more particularly to FIGS. 1 through 4, the portable abduction exercise device of the present invention can be used by a human 10, as shown in FIG. 1, having first and second limbs or legs 11 and additional first and second limbs or arms 12. Legs 11 have upper portions 13 which include thigh portions 13*a* and knees 13*b* and outer surfaces 13*c*. Portable exercise device 15 includes a rod 16 made from a spring material such as steel or other suitable metal and having opposite ends 17. The rod has a generally circular cross-section and is approximately 0.3 inches (0.76 cm) in diameter. Rod 16 is formed with a helical central portion or spring 18 which serves as a pivot and spring means. Spring 18 has a diameter ranging from two and one-half inches (6.35 cm) to three and one-half inches (8.89 cm) and is formed from approximately three and one-half coils 19 (See FIGS. 1 and 2).

Rod 16 has opposite first and second end portions which extend from spring 18 and serve as first and second spaced apart arms 21 adapted for engagement by the human. Arms 21 range in length from 15 to 25 inches (38.1 to 63.5 cm) and are substantially identical in shape. Each arm 21 has a proximal portion or stem 22 joined or connected to spring 18 and a distal portion or grip 23 joined to the end of the stem. When arms 21 are in a relaxed first or home position, as illustrated by solid lines in FIG. 2, stems 22 each extend from spring 18 in the same general direction and are generally parallel to each other. More specifically, stems 22 diverge slightly and are angled apart at between 10 and 40 degrees and preferably approximately 15 degrees. Spring 18 permits arms 21 to pivot about the spring in angular directions identified by arrows 26 in FIG. 2. When arms 21 are urged by the human in a direction 26 to a second or extended position, as illustrated by dotted lines in FIG. 2, arms 21 are pivoted outwardly and away from each other about spring 18 so that stems 22 are angled apart to a greater extent than when in the first position. Spring 18 biases arms 21 toward the first position.

Figure 2:
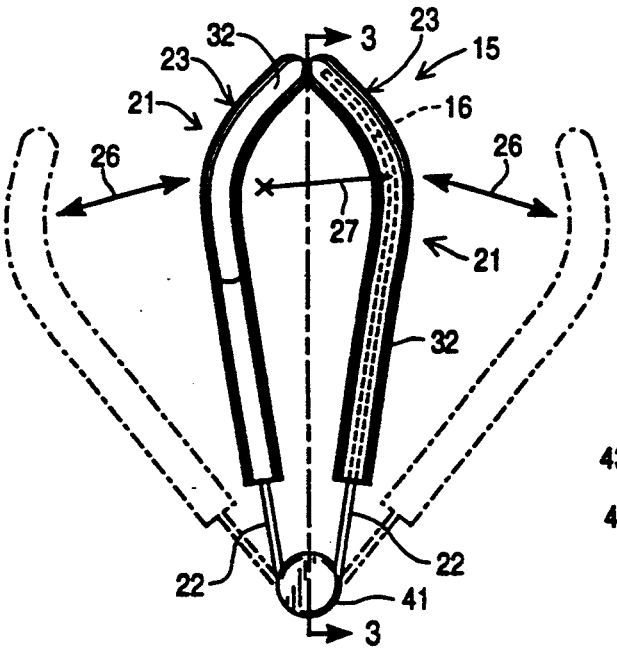
FIG. 2 is a side elevational view of the portable exercise device shown in FIG. 1.

Grips 23, when viewed in profile as in FIG. 2, extend generally colinearly from respective stems 22 before curving toward each other. The curve formed in each grip 23 has a radius identified by radius 27 which ranges from two to four inches (5.08 to 10.16 cm) in length and subtends an angle ranging from approximately 30 to 80 degrees and preferably from approximately 45 to 65 degrees. Grips 23 extend linearly beyond the curve formed by radius 27 a distance approximately two to six inches (5.08 to 15.24 cm). The tips of each grip 23 approach each other and generally touch when arms 21 are in the first position.

Figure 3:
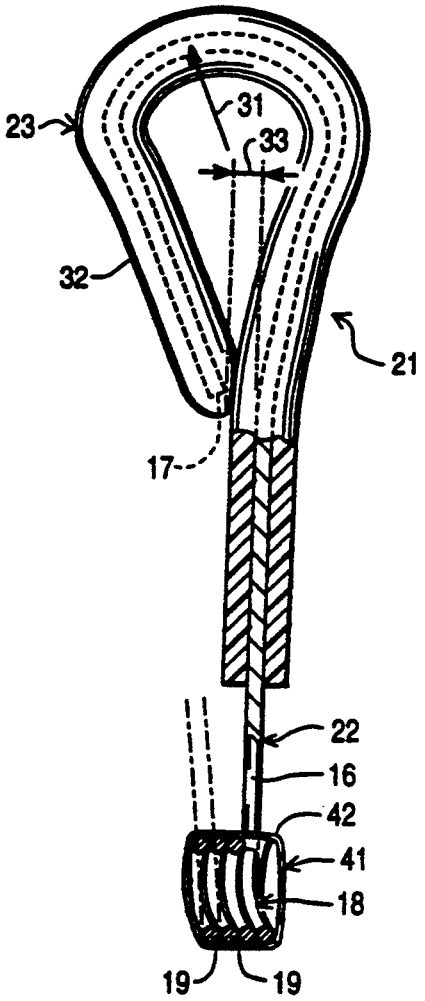
FIG. 3 is a cross-sectional view taken along the line 3—3 of the portable exercise device shown in FIG. 2 and partially cut away.

Rod 16 is turned back on itself at each end so that grips 23, when viewed in plan as in FIG. 3, are generally looped in configuration. Rod ends 17 are distanced from the central portion of each arm 21 to form a gap 33 ranging from approximately one-half to two inches (1.27 to 5.08 cm). The loops each have a radius, indicated by radius 31 in FIG. 3, ranging from two to four inches (5.08 to 10.16 cm) in length. Each loop generally forms a plane which, as shown in FIG. 2, is generally perpendicular to the plane defined by the direction of travel 26 of arms 21 between the first and second positions.

Padding in the form of a flexible tube or sleeve 32 is provided for cushioning the human during use of exercise device 15. Each sleeve 32 is made of any suitable material such as foam and is positioned on the related arm 21 by being slipped over the end thereof and slid into place. Gap 33 permits sleeves 32 to be so mounted to grips 23. A sleeve 32 covers each grip 23 and extends down the related arm 21 toward spring 18.

Figure 4:
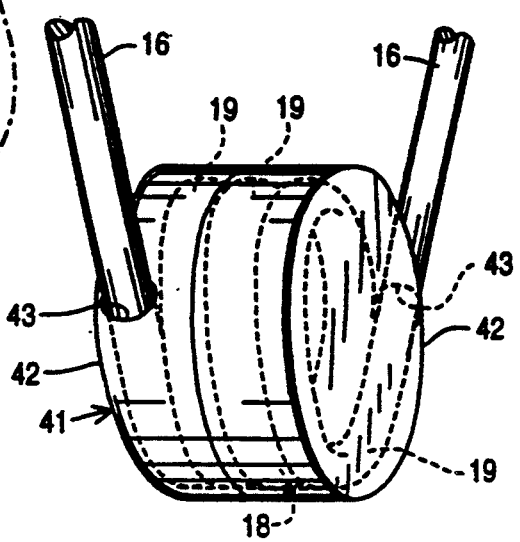
FIG. 4 is an enlarged perspective view of a portion of the portable exercise device shown in FIG. 1.

Device 15 includes a covering 41 for spring 18 and stems 22 for protecting the human against injury therefrom during use of the device (See FIGS. 2 through 4). Covering 41 is made of any suitable material such as a thin deformable plastic and has substantially identical mating first and second sections 42, one for covering each end of spring 18. Each cap section 42 is generally circular in cross-section and closed at one end. A hole 43 extends through the side of each cap section. Covering 41 is mounted to rod 16 before sleeve 32 by inserting each rod end 17 through one hole 43 of a cap section 42 and slipping the cap section down the related arm 21 to spring 18.

In operation and use, device 15 can be used as an abduction device to exercise the outer muscles of the legs or arms. In FIG. 1, device 15 is mounted on the outside of the legs and is being used to exercise the muscles of the buttocks and the proximal end and latter sides of the legs. These muscles include the gluteus maximus, medius and minimus, the tensor fasia latae, the performis, the orbturator internus and externus, the gemellus superior and inferior and the quadratus femoris.

For positioning device 15 for use as shown in FIG. 1, arms 21 thereof are separated sufficiently to permit grips 23 to extend around the legs of the human and to sandwich the legs between grips 23. For use, the human abducts the legs against arms 21 and the biasing force and resistance of spring 18 to increase the angle separation of arms 21. This movement contracts the muscles of the gluteus group and abducts and rotates the femur both laterally and medially. The muscles of the buttocks work together to stabilize the hip joint and are responsible for maintaining the erect posture of the human as well as stabilizing the knee. The human then slowly relaxes the exercised muscles to bring the legs together. This action is repeated as many times as desired.

The curved ends of grips 23 secure device 15 to the legs of the human during use so as to restrain the device from slipping off the human during use. The compound curve of grips 23 further facilitate the snug disposition of the device against the legs when the legs are at their farthest separation. Device 15 need not be held by the human during use on the legs. The looped configuration of grips 23 provides an enlarged area for spreading the resistance forces of device 15 over the outside of the human's legs. These loops have a radial dimension of sufficient size so as to stabilize device 15 during use and limit undesired contractions thereof. Foam sleeve 32 cushions the force of device 15 against the legs and also serves to enhance the grip of device 15 to the legs, while spring 18 is enclosed for safety and appearance. Exercise device 15 can be used for exercising other muscles of the human body. For example, the deltoids can be worked by the human using both hands to pull arms 21 of the device out in front of the body. The triceps can be worked by placing device 15 against the torso while seated, holding one arm 21 with one hand and pushing the other arm 21 away by extension of the tricep of the other arm of the human. Device 15 can also be used by competitive bodybuilders for practicing mandatory posing stances in which the competitor is standing with feet turned out at an approximate 45 degree angle. In this use, the human flexes the glutes and supinates against the resistance of the device, isometrically holding this position for the desired length of time while posing the upper body. In another use, the human can practice singing while extending the device 15 as shown in FIG. 1. Exercise of this type while vocalizing compresses the energy and forces the breath up the body and out the mouth.

Exercise device 15 is relatively simple in design and inexpensive in cost. The device is relatively compact for facilitating storage and portability. No assembly or adjustments are needed for use. Although dimensions of rod 16, spring 18 and arms 21 have been included herein, these dimensions can be changed for altering the operating characteristics of device 15 and be within the scope of the present invention.

Figure 5:
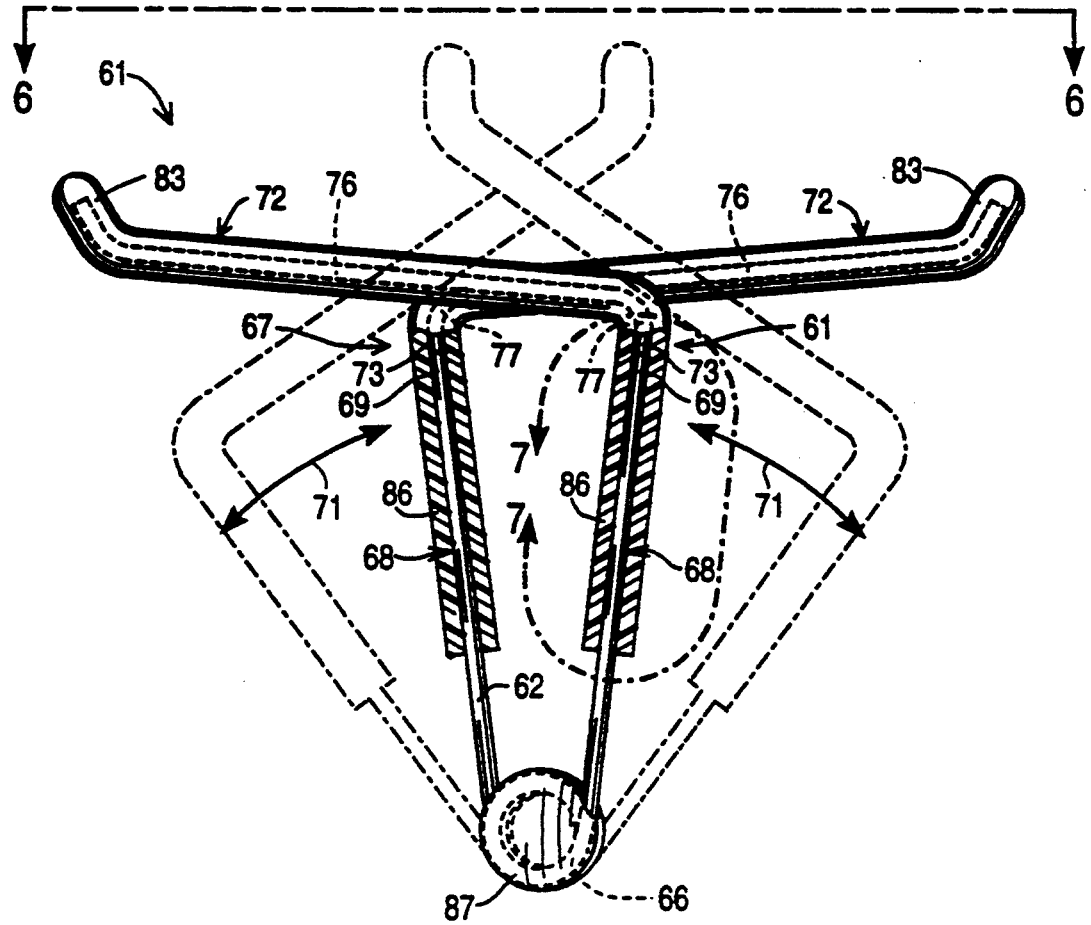
FIG. 5 is a side elevational view, partially cut away, of another embodiment of the portable exercise device of the present invention.
Figure 6:
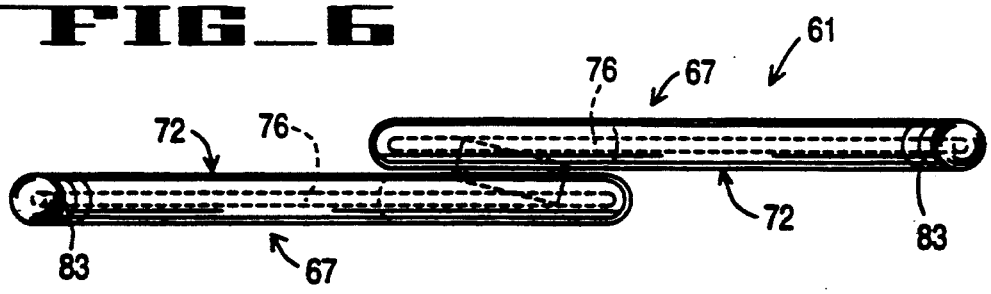
FIG. 6 is a top plan view taken along the line 6—6 of the portable exercise device shown in FIG. 5.
Figure 7:
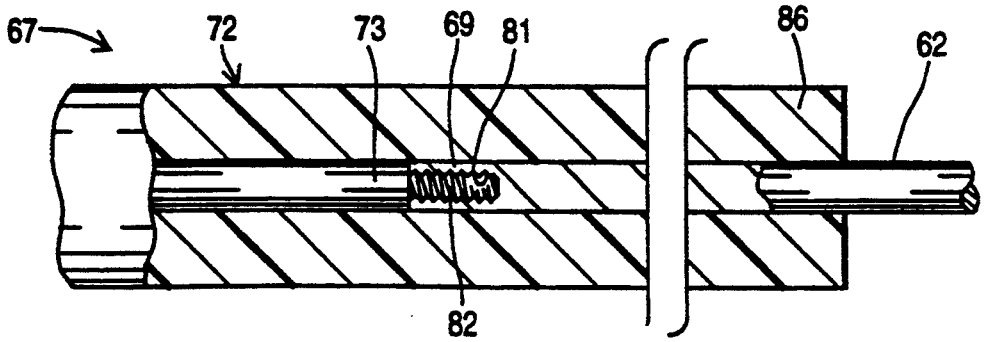
FIG. 7 is an enlarged view taken along the line 7—7, partially cut away and rotated 90 degrees, of the portable exercise device shown in FIG. 5.

In another embodiment of the portable exercise device of the present invention, an exercise device 61 is provided which can be converted from an adduction exercise device to an abduction exercise device and vice versa. Device 61, illustrated in FIGS. 5 through 7, is similar to exercise device 15 discussed above in many respects and includes a rod 62 made of a suitable material such as steel. Rod 62 has a similar cross-sectional configuration and dimension as rod 16, and is formed with a helical central portion or spring 66 which serves as a pivot and spring means and is substantially identical to spring 18.

Device 61 has first and second spaced apart arms 67 extending from spring 66 which are adapted for engagement by the human and are substantially identical in shape. Rod 62 has first and second end portions which extend from spring 66 and serve as proximal portions or stems 68 of arms 67. Stems 68 have respective ends 69 and are substantially identical to stems 22. Stems 68 have a configuration with respect to spring 66 which is substantially identical to the configuration of stems 22 with respect to spring 18. In this regard, when arms 67 are in a relaxed or home first position, as illustrated by solid lines in FIG. 5, stems 68 each extend from spring 66 in the same general direction and are generally parallel to each other. Spring 66 permits arms 67 to pivot about the spring in angular directions identified by arrows 71 in FIG. 5. When arms 67 are urged by the human in a direction 71 to a second or extended position, as illustrated by dotted lines in FIG. 5, stems 68 are pivoted outwardly and away from each other about spring 66 so that they are angled apart. Spring 66 biases arms 67 toward the first position.

Arms 67 further include first and second arm distal portions or extenders 72 also made of a suitable material such as steel and having cross-sectional characteristics similar to rod 62. Each extender 72 has a first end 73 for coupling the extender to respective stem end 69, a central portion 76 and a generally right elbow 77 adjoining first end 73 and interconnecting it to central portion 76. The central portions extend from elbows 74 in directions generally perpendicularly from related stem ends 69, the directions being generally opposite from each other. More specifically, extenders 72 extend toward and then beyond each other when device 61 is in both its first and second positions as illustrated in FIG. 5. The configuration of each extender 72 is generally planar, with the plane formed by the two extenders 72 being generally parallel and in juxtaposition with each other as illustrated in FIG. 6.

Means is carried by stems and extenders 68 and 72 for removably coupling or attaching extender first ends 73 to respective stem ends 69. In this regard, each stem end 73 is provided with a threaded bore 81 at the end thereof and each extender end 73 is provided with a threaded stud 82 at the end thereof (See FIGS. 5 and 7). Each threaded bore 81 is dimensioned and configured to receive the respective threaded stud 82, with the bore 81 and stud 82 serving as first and second cooperatively mating threaded elements. Each extender 72 is also formed with a second end or pad 83 formed at an oblique angle to central portion 76.

Exercise device 61 is provided with padding and covers similar to those provided for exercise device 15. Padding in the form of a flexible tube or sleeve 86 is disposed on each extender 72 for cushioning the human during use of device 61. Each sleeve 86 is made of any suitable material such as foam and is slipped over the length of the extender and extends down the related arm toward spring 66 past stem end 69. A covering 87 substantially identical to covering. 41 is also provided for spring 66 and stems 68.

Device 61 can be operated as a portable exerciser for strengthening the inner muscles of the legs and thighs. The device is sandwiched between the separated legs of the human with pads 83 abutting the inside of the knees or lower thighs. The human forces the legs together against the resistance force of spring 66 thereby angularly separating stems 68 and urging device 61 toward its second position. When the human gradually relaxes the muscles of the legs, device 61 returns to its first relaxed position. In this manner, extenders 72 serve to cause device 61 to operate as an adduction exercise device.

Threaded bores and studs 81 and 82 carried by extenders 72 and stems 68, respectively, permit conversion of device 61 from an adduction exercise device to an abduction exercise device or vice versa. In this regard, extenders 72 can be easily removed from stems 68 to permit attachment of distal portions substantially identical to grips 23 so that device 61 can be used as an abduction exercise device in the manner discussed above. Injury to the human by engaging the coupling between stems 68 and extenders 72 is minimized by foam sleeve 86 which covers same.

Figure 8:
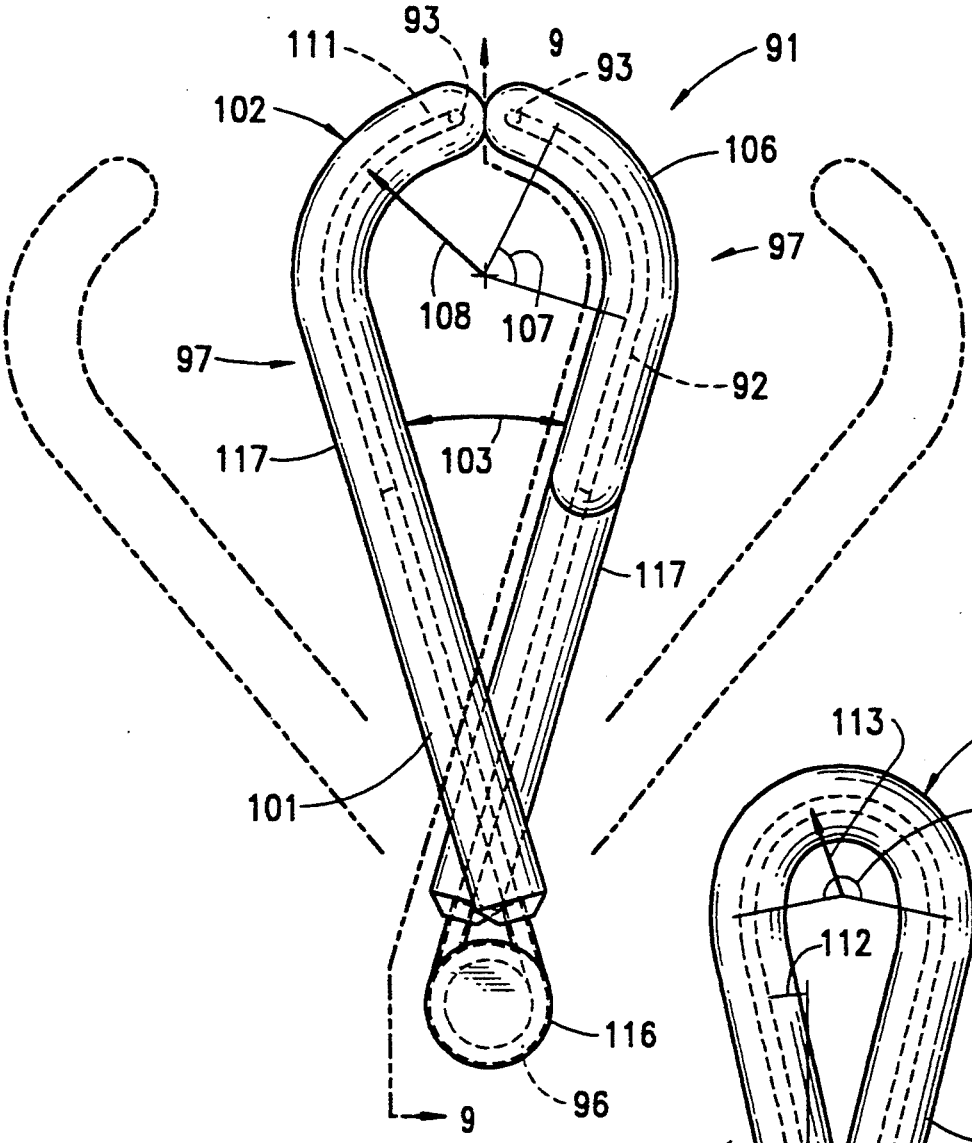
FIG. 8 is a side elevational view of another embodiment of the portable exercise device of the present invention.
Figure 9:
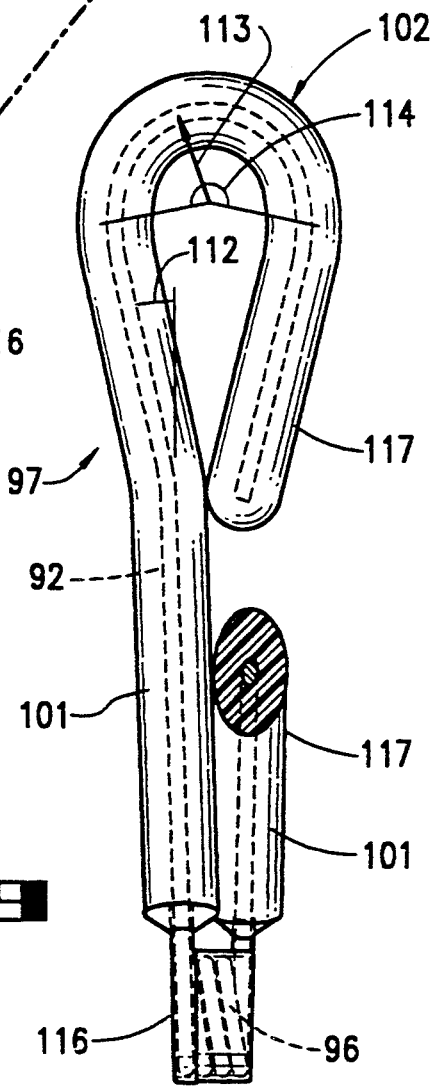
FIG. 9 is a cross-sectional view taken along the line 9—9 of the portable exercise device shown in FIG. 8.

Another embodiment of the portable exercise device of the present invention is illustrated in FIGS. 8 and 9 where an exercise device 91 is illustrated. Exercise device 91 is similar to exercise device 15 and is formed by a rod 92 made from any suitable material such as steel and having opposite ends 93. Rod 92 has a cross-section substantially identical to that of rod 16 and is formed with a helical central portion or coil spring 96 which is substantially identical to spring 18 and serves as a pivot means and spring means for exercise device 91. Spring 96 has a diameter ranging from approximately one inch (2.54 cm) to three and one-half inches (8.89 cm)

Rod 92 is further formed so that exercise device 91 has first and second elongate arms 97 having proximal end portions or extremities in the form of stems 101 and distal end portions or extremities in the form of grips 102. Generally straight stems 101 extend from opposite ends of coil spring 96 and in this manner the coil spring is included within the means of exercise device 91 for interconnecting arm stems 101. Stems 101 extend in generally the same direction when exercise device 91 is in a relaxed or home position as illustrated in solid lines in FIG. 8. More specifically, stems 101 extend toward each other so as to cross and thereafter diverge at an angle 103 ranging from approximately 20 to 40 degrees and preferably approximately 33 degrees.

Grips 102 are formed to be adapted for engagement by legs 11 of human 10 and, as such, are substantially similar to grips 23 of exercise device 15. Grips 102 generally curve toward each other with a substantial curvature over a substantial length so as to grip outer surfaces **13*c* of upper leg portions 13. In this regard, the grips have an arcuate portion or curve 106 which subtends at an angle 107 ranging from approximately 50 to 100 degrees and preferably from approximately 60 to 90 degrees and has a radius 108 which ranges from two to five inches (5.08 to 12.70 cm) in length. Grips 102 further include an end portion or extension 111 which extends beyond curve 106 a distance ranging from approximately one to four inches (2.54 to 10.16 cm). The tips of each grip approach each other and generally touch when arms 97** are in their relaxed position.

Grips 102 are generally looped when viewed in side elevational plan as shown generally in FIG. 9. In this regard, rod 92 extends outwardly from stem 101 at an angle 112 of approximately 15 degrees before curving in the opposite direction through a curve having a radius 113 ranging from one to four inches (2.54 to 10.16 cm) and subtending an angle 114 of at least approximately 90 degrees and more specifically between 90 and 140 degrees so that rod 92 curves back onto itself.

Coil spring 96 yieldably urges grips 102 in a direction toward each other to their relaxed or home position. The coil spring also permits yieldable movement of grips 102 in an opposite direction away from each other so that arms 97 can assume a second or extended position shown in dotted lines in FIG. 8.

Rod 92 is substantially covered so as to minimize injury to the user of exercise device 91. A two-piece covering 116 substantially identical to covering 41 encapsulates coil spring 96 and extends therefrom up at least a portion of stems 101. Exercise device 91 further includes padding for each arm 97 in the form of a flexible tube or sleeve 117 substantially similar to sleeves 32 of exercise device 15. Each protective sleeve 117 extends from the end of covering 116 up the respective arm 97 and beyond rod end 93.

In operation and use of the exercise device and method of the present invention, device 91 is utilized in the substantially the same manner as described above with respect to exercise device 15 to provide exercise to legs 11 and the buttocks of the user. In one preferred form of exercise therewith, human 10 sits on a chair as shown in FIG. 1 and grips 102 are placed around the outside of legs 11 while the legs are in a juxtaposed position with knees **13*b* in general engagement with each other. More specifically, coil spring 96 and stems 101 are placed below upper leg portions 13 and grips 102 are spread slightly apart so as to engage outer surfaces 13*c* of upper legs portions 113 at a position generally adjacent to or at knees 13*b*. Arms 97 are then moved away from each other under abduction forces exerted by legs 11 to provide exercise to the muscles of legs 11** and the buttocks. The abduction of the leg contracts the muscles of the gluteus group and abducts and rotates the femur both laterally and medially. The muscles of the buttocks work together to stabilize the hip joint and are responsible for maintaining the erect posture of the human and stabilizing the low back and the knee so as to enable locomotion.

One of the important features of the exercise device of the present invention is that it strengthens and tightens the muscles that make up the pelvic girdle. It is because of the oblique design of muscle that when the legs are pulled away from the centerline of the body, as in abduction, the femur rotates so as to cause a twisting or milking action to occur. As will be appreciated by those skilled in the art, all muscles of the body are interrelated. The more superficial muscles are concerned with locomotion while the deeper muscles create a bowl or sling-like dish known as the pelvic girdle. During abduction, the body cavity is closed tighter, thereby creating a strengthening effect of the whole lower torso.

Unlike some conventional exercise devices which require the ankles and feet of the user to move outwardly and inwardly during abduction exercise, exercise device 91 permits the feet of the user to remain stationary on the ground in juxtaposition to each other. When legs 11 are abducted with the feet in such a stationary position, the contraction of the gluteus maximus and other muscles in this group is improved and these muscles are tightened. Since grips 102 are positioned away from the pivot point of the hips, the forces required to abduct exercise device 91 are greater than those necessary for exercising this muscle group with conventional devices. More specifically, because the point of resistance is at the distal end of the femur on the lateral side of the knee, the leverage is stronger and the movement is more isolated than conventional devices currently available. These greater forces enhance the benefit to the muscles of the pelvic girdle. In addition, the exercise device of the present invention is less personal than conventional devices currently available.

The strengthening or tightening of the muscles of the pelvic girdle has many benefits. It is these muscles which assist a singer in projecting his or her voice. The exercise of these muscles can also improve urinary bladder control functions or incontinence and facilitates bowel movements. The waste of the body is eliminated much like toothpaste from a tube when one end of the tube is squeezed. This is critically important to avoid a pushing effect which hardens the tissue and causes circulatory problems. These same muscles are also utilized during giving birth by squeezing and condensing the size of the pelvic bowel or dish.

As discussed above with respect to exercise device 15, curves 106 of grips 102 serve to secure the exercise device to legs 11 during use. The substantial curvature of curves 106 conforms to the curvature of outer surfaces **13*c* and inhibits the exercise device from slipping off thigh portions 13*a*. The looped configuration of the grips spreads the reactive forces of the exercise device over outer surfaces 13*c*. Protective sleeve 117** facilitates the distribution of these forces and cushions the user during use.

The crossing of arm stems 101 hinders the deformation of coil spring 96 during use of exercise device 91. Coil spring 96 is further wound about itself when arms 97 are urged by the user to their second or extended position. In contrast, spring 18 of exercise device 15 is unwound as arms 21 of exercise device 15 are urged outwardly during use. It has been found that the winding or coiling of coil spring 96 during use is not likely to undesirably deform spring 96.

Exercise device 91 can also be utilized for exercising the legs through abduction when human 10 is in several other positions not shown in the drawings. For example, the user can be standing and coil spring 96 placed behind upper leg portions 13 so that stems 101 extend forwardly in a general horizontal direction and grips 102 engage the outside of upper leg portions 13. The user can also be reclined on a support surface with the upper leg portions extending upwardly from the support surface and the feet resting on the surface or elevated thereabove. When exercise device 91 is used in this manner, coil spring 96 is placed below upper leg portions 13 so that stems 101 extend generally vertically. Exercise of the muscles of the pelvic girdle is enhanced when the legs of the user are bent at the knee and when the knees are abducted a distance greater than the spacing between the feet.

It is apparent from the foregoing that a portable abduction exercise device for humans has been provided which is simple in design and relatively compact for ease of storage and transportation. The exercise device can exercise the outer muscles of the legs and arms and is configured to grip the legs of the human when being used to exercise the muscles of the legs and buttocks. The device need not be held by the hands of the human when being used to exercise the legs and can be easily converted to an adduction exercise device. While only certain presently preferred embodiments have been described in detail, as will be apparent to those familiar with the art, certain changes and modifications can be made without departing from the scope of the invention as defined by the following claims.

What is claimed is:

1. A portable exercise device for use by a human through abduction of the upper portions of the legs of the human comprising a spring means, first and second spaced apart arms having proximal portions joined to the spring means and distal portions adapted for engaging the outside of the upper portions of the legs, the spring means biasing the arms toward a first position in which the distal portions are in close proximity to each other, the arms having a length which is sufficient to permit the distal portions to engage the outside of the upper portions of the legs when the arms are in the first position and the upper portions of the legs are in a generally juxtaposed position, the spring means serving as a pivot to permit the arms to move away from each other to a second position when so urged by the human spreading apart the upper portions of the legs, the distal portions being generally curved toward each other with a substantial curvature over a substantial length and serving as means for gripping the outside of the upper portions of the legs so as to retain the device on the legs during use.

2. A portable exercise device as in claim 1 wherein the spring means includes a helical central portion of a rod and the arms include the end portions of the rod which extend from the helical central portion.

3. A portable exercise device as in claim 1 wherein the distal portions of the arms travel in opposite directions between the first and second positions and wherein the distal portions are each generally looped in directions perpendicular to said opposite directions so that the forces between the device and the upper portions of the legs are distributed over the upper portions of the legs.

4. A portable exercise device as in claim 1 together with padding provided on the distal portions for cushioning the human during use of the device.

5. A portable exercise device as in claim 1 wherein the distal portions of the arms are in engagement with each other in the first position so as to preload the device.

6. A portable exercise device as in claim 1 wherein the proximal portions of the arms cross each other.

7. A portable exercise device for use by a human through abduction of first and second limbs of the human comprising a spring means, first and second spaced apart arms having proximal portions joined to the spring means and distal portions adapted for engagement by the limbs of the human, the spring means biasing the arms toward a first position in which the distal portions of the arms abut and serving as a pivot to permit the arms to move away from each other to a second position when so urged by the human whereby the abutting of the distal portions of the arms permits a full range of exercise during abduction of the limbs of the human.

8. A portable exercise device as in claim 7 for use with the legs of the human wherein the distal portions of the arms have a configuration adapted to grip the upper portions of the legs therebetween.

9. A portable exercise device for use by a human comprising a spring means, first and second spaced apart arms having proximal portions joined to the spring means and distal portions adapted for engagement by the human, the spring means biasing the arms toward a first position and permitting them to pivot thereabout to a second position when so urged by the human, and conversion means for altering the configuration of the arms to permit conversion of the device from an abduction exercise device to an adduction exercise device or vice versa.

10. A portable exercise device as in claim 9 wherein the conversion means includes coupling means for removably attaching the distal portions of the arms to the proximal portions of the arms.

11. A portable exercise device as in claim 10 wherein the proximal and distal portions have respective ends which attach and wherein the coupling means includes cooperatively mating threaded elements carried by the respective ends.

12. A portable exercise device as in claim 9 wherein when the arms are in the first position the proximal portions extend from the spring means in the same general direction and when the arms are in the second position the proximal portions angle apart from each other.

13. A portable exercise device as in claim 12 wherein the distal portion of each arm extends generally perpendicularly from the proximal portion of the arm and beyond the proximal portion of the other arm so as to permit the device to be used as an adduction exercise device.

14. A portable exercise device as in claim 9 for use with the legs of the human wherein the distal portions are generally curved toward each other with a substantial curvature over a substantial length so as to grip the outside of the upper portions of the legs and inhibit the device from slipping off the upper portions of the legs during use.

15. A portable exercise device for use by a human having first and second limbs comprising first and second arms having proximal and distal extremities, the arms extending in directions so as to cross each other and the distal extremities being formed to be adapted for engagement by the limbs of the human, means interconnecting the proximal extremities and including spring means for yieldably urging the distal extremities in a direction toward each other and permitting yieldable movement of the distal extremities in a direction away from each other under abduction forces exerted by the first and second limbs of the human to provide exercise to the first and second limbs of the human whereby the crossing of the arms hinders deformation of the spring means during use.

16. A portable exercise device as in claim 15 wherein the first and second limbs are legs having thigh portions with outer surfaces and wherein the distal extremities of the first and second arms are formed with arcuate portions which are curved to grip the outer surfaces of the thigh portions to inhibit the device from slipping off the thigh portions during use.

* * * * *